US006047819A

United States Patent [19]

Borst et al.

[11] Patent Number: 6,047,819

[45] Date of Patent: Apr. 11, 2000

[54] CLAM SHELL CONTAINER WITH GRAPHIC INSERT

[75] Inventors: Rodney D. Borst, Oregon; Daniel F. Mohs, Middleton, both of Wis.

[73] Assignee: Placon Corporation, Madison, Wis.

[21] Appl. No.: 09/263,305

[22] Filed: Mar. 5, 1999

[51] Int. Cl.[7] ..... B65D 69/00

[52] U.S. Cl. ..... 206/232; 206/459.5

[58] Field of Search ..... 206/232, 470, 206/472, 459.5; 220/4.22, 4.23, 837, 838, 839

[56] References Cited

U.S. PATENT DOCUMENTS

| | | | |
|---|---|---|---|
| 4,619,364 | 10/1986 | Czopor, Jr. | 206/470 |
| 4,892,220 | 1/1990 | Foos | 220/839 |
| 5,366,104 | 11/1994 | Armstrong | 220/837 |
| 5,441,150 | 8/1995 | Ma | 220/839 |
| 5,456,379 | 10/1995 | Krupa et al. | 220/839 |
| 5,791,482 | 8/1998 | Murphy et al. | 206/470 |

*Primary Examiner*—David T. Fidei
*Attorney, Agent, or Firm*—Lathrop & Clark LLP

[57] ABSTRACT

A plastic hinged clamshell box receives a stiff paper card within inwardly extending lid detents. The base has a bottom wall with side walls which extend upwardly and terminate at an outwardly extending peripheral lip. A skirt extends downwardly from the peripheral lip and detents extend inwardly from the skirt on multiple sides of the box. The lid has a top wall with downwardly extending side walls, with portions which extend inwardly toward the base skirt forming one or more detents on multiple sides of the lid. The card is of about the dimensions of the lid top wall and is positioned adjacent and beneath the lid top wall within the lid side walls. The stiff card is supported on the lid detents when the lid is disengaged from the base, such that the detents retain the card on the lid. The card is clasped between the base peripheral lip and the lid top wall when the lid is closed upon the base.

12 Claims, 2 Drawing Sheets

CLAM SHELL CONTAINER WITH GRAPHIC INSERT

BACKGROUND OF THE INVENTION

The present invention relates to containers in general and to reclosable containers with graphic displays in particular.

For centuries boxes with reclosable lids have been used to retain, organize, and protect personal belongings of all sorts. From the richly decorated enamel or marquetry jewel box which centrally stores precious gems to the child's cigar box which holds a collection of baseball cards, reclosable boxes are prized for their appearance as much as for their utilitarian functions.

The outward appearance of a box can aid the owner in recalling the box's contents by associating color or design with the items within. Pleasing ornamentation, moreover, satisfies an owner's natural desire to preserve and display possessions in an attractive manner.

Where box construction was once the province of the cabinet maker, the carpenter, the tinsmith, or the metal worker, modern manufacturing techniques have made possible containers of all shapes and sizes at very low cost. Plastic molding processes, in particular, permit the formation of simple containers on a mass production basis.

Injection molding and thin sheet thermoforming can produce boxes of solid opaque colors, of transparent plastic, or a combination of the two. Yet, although molding processes readily apply bas relief or intaglio decoration, photographs, drawings, or reproductions of artworks cannot be produced in the molding operation. Decorations of this type are sometimes provided in a plastic container by applying an adhesive to the rear surface of a paper label prepared in a separate printing process and affixing the label to a surface of the container. This gluing step can add cost to the manufacture of the decorated container, and, in any event, presents a container with decoration which is permanently secured and not amenable to variation.

What is needed is a low cost container which is readily provided with decorative elements which may be replaced or removed if desired.

SUMMARY OF THE INVENTION

The container of this invention has a plurality of mechanical detents which retain a printed card so that it may be viewed through a transparent lid top wall when the lid is closed on a base to which it is hinged, or when the lid is in an open configuration. The container assembly is comprised of a plastic hinged clamshell box with a stiff paper card received within the lid detents. The base has a bottom wall with side walls which extend upwardly and terminate at an outwardly extending peripheral lip. A skirt extends downwardly from the peripheral lip and detents extend inwardly from the skirt on each side of the box except for the side adjacent the hinge. The lid has a top wall with downwardly extending side walls, with portions which extend inwardly toward the base skirt forming one or more detents on each side of the lid except for the side which is hinged. The card is of about the dimensions of the lid top wall and is positioned adjacent and beneath the lid top wall within the lid side walls. The stiff card is supported on the lid detents when the lid is disengaged from the base, such that the detents retain the card on the lid. The card is clasped between the base peripheral lip and the lid top wall when the lid is closed upon the base.

It is an object of the present invention to provide a reclosable container with a graphic element which is retained on the container without adhesives.

It is a further object of the present invention to provide a decorative reclosable container which is economically produced.

It is an additional object of the present invention to provide a reclosable container which has readily replaced graphic features.

It is also an object of the present invention to provide a clamshell container with a lid which can be latched in a partially closed condition to facilitate full closure in an automatic assembly operation.

It is another object of the present invention to provide a clamshell container in which a printed card is clasped firmly between the base and the lid in a closed configuration.

It is a still further object of the invention to provide a container in which the lid structure which retains a card associate with the lid also serves as a portion of a container closure.

It is yet another object of the invention to provide a clamshell container with a wide graphic display area.

Further objects, features and advantages of the invention will be apparent from the following detailed description when taken in conjunction with the accompanying drawings.

DESCRIPTION OF THE PREFERRED EMBODIMENTS

Figure 2:
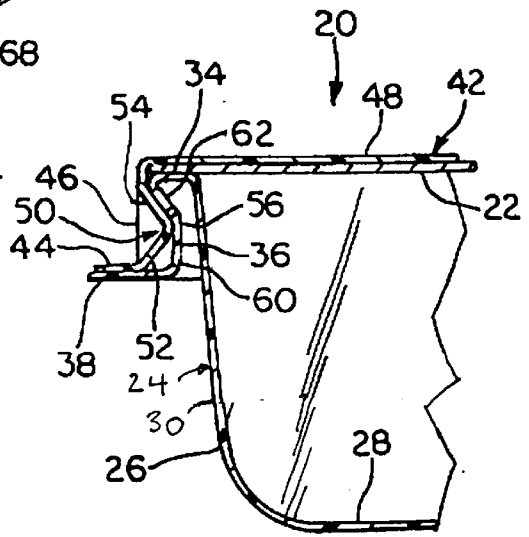
FIG. 2 is a cross-sectional view of the container of FIG. 1, shown in a closed configuration, and taken generally along section line 2—2.
Figure 1:
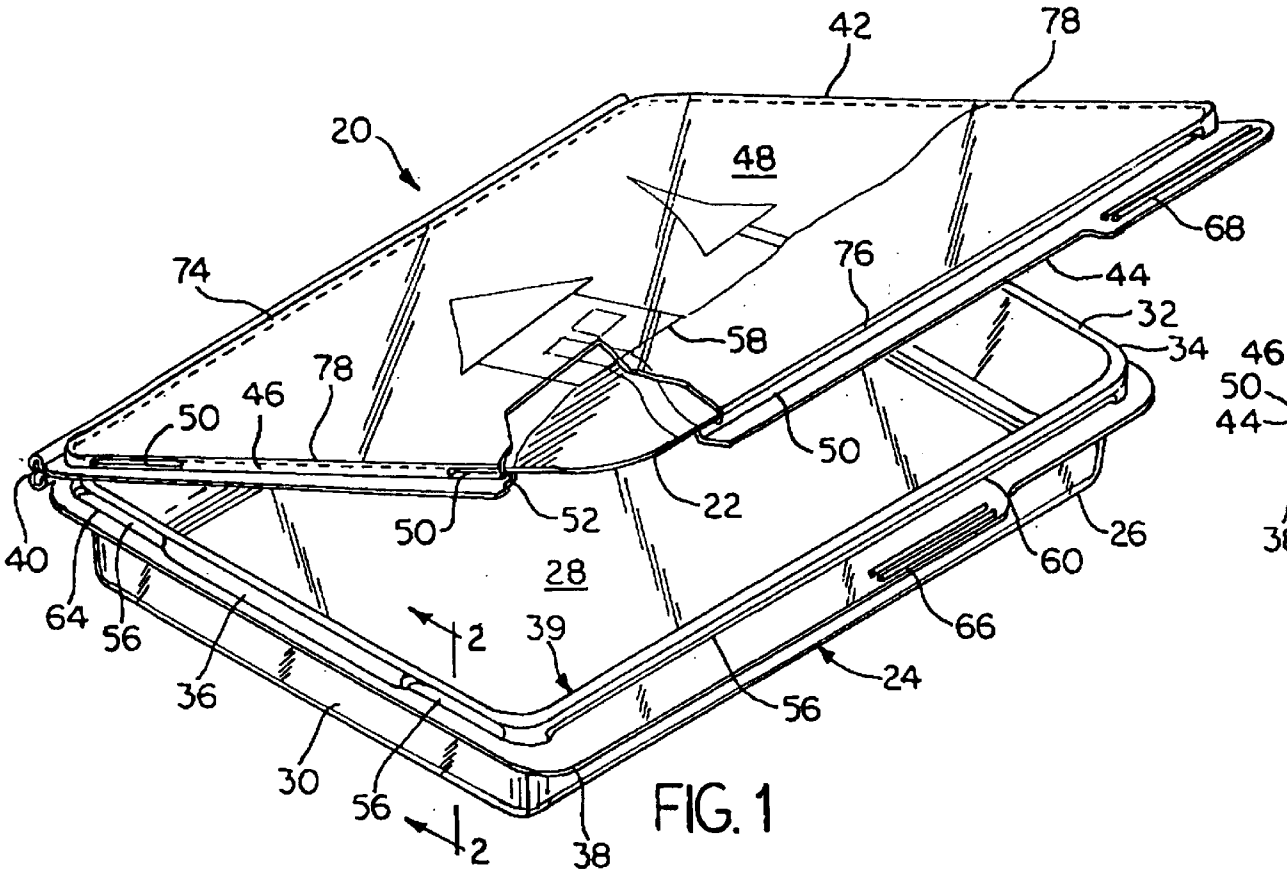
FIG. 1 is an isometric view, partially broken away in section, of the container of this invention in a partially open configuration.
Figure 3:
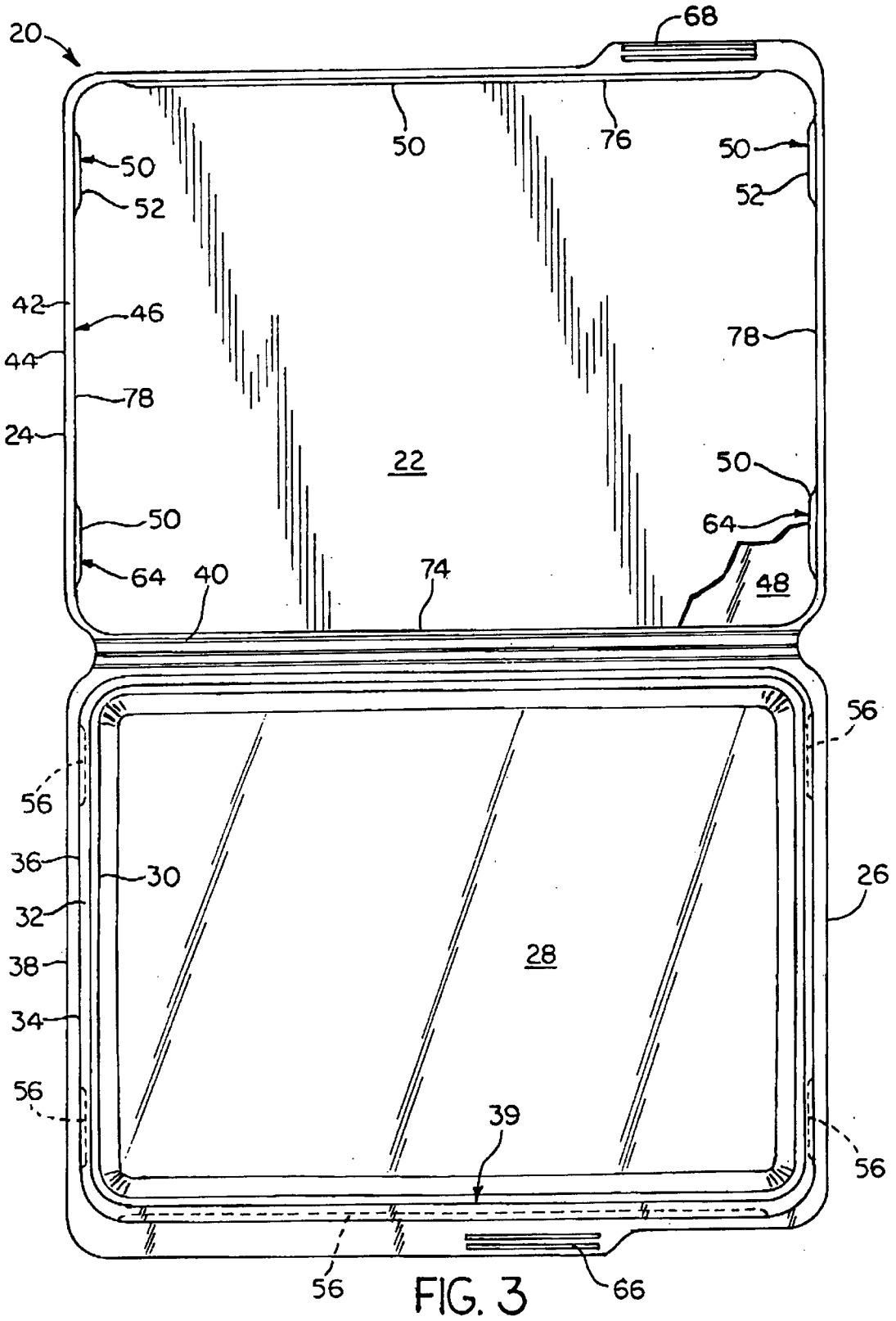
FIG. 3 is a top plan view of the container of FIG. 1 shown in a fully open configuration, with the graphic card retained on the opened lid partially broken away.

Referring more particularly to FIGS. 1–3, wherein like numbers refer to similar parts, a container assembly 20 is comprised of a printed card 22 mechanically retained within a clamshell container 24. The container 24 may be formed from a thin sheet of transparent thermoplastic material in the single sheet thermoforming process. The container may be formed of RPET, PET, HIPS, high density polyethylene, or polyurethane, or other suitable plastic material. Thermoformed sheet material will generally be from about 0.007 inches thick to 0.07 inches thick.

The container has a base 26 having a bottom wall 28 which will generally rest upon a planar support surface. Base side walls 30 extend upwardly from the bottom wall 28 and encircle the bottom wall. The side walls 30 are terminated at an upper perimeter 32 by an outwardly extending peripheral lip 34. The lid 34 may be relatively narrow, on the order of about ¼ in. wide. A peripheral skirt 36 extends downwardly from the lip 34 and is spaced outwardly from the base side walls 30. The skirt 36 is terminated at its lower edge by an outwardly extending base flange 38. A product compartment 39 is defined between the base bottom wall 28 and the base side walls 30

And integral linear hinge 40 joins a transparent lid 42 to the base 26. The hinge 40 may be a C-shaped hinge or, as shown in FIG. 3, a W-shaped hinge having two adjacent semicircular cross-section segments. A lower lid flange 44 extends from the hinge 40 and surrounds a lid side wall 46 which extends upwardly and is terminated by a lid top wall 48. The lid 42 is pivotable about the hinge 40 between an open position and a closed position in which the lid flange 44 is disposed over the base flange 38 in such a manner that the lid covers and closes the base. The lid side walls 46 include a rear side wall 74 adjacent the hinge 40, a front side wall 76 positioned opposite the rear side wall, and two transverse side walls 78 which extend between the rear side wall and the front side wall.

The card 22 may be formed of paperboard, chip board, plastic, or other suitable stiff and printable material. The card 22 is die cut or molded to have dimensions approximately conforming to those of the lid top wall 48. Each of the lid side walls 46 on a side not extending along the hinge 40 has one or more inwardly extending detents 50. Each detent 50 extends beneath the lid top wall and thus supports the card 22 in engagement with the lid when the lid is not closed upon the base 26. As shown in FIG. 2, each detent 50 may have a lower segment 52 which extends inwardly and upwardly from the lid flange 44 and an upper segment 54 which extends upwardly and outwardly from the lower segment back to the lid side wall. The lid detents 50, although they extend inwardly only about ⅛ inch to about ¼ of an inch, and always less than the width of the base peripheral lip 34, are nevertheless sufficient to securely retain the card 22 in connection with the lid. The card should be cut, however, such that the variance between the card's dimensions and the lid top wall's dimensions is not greater than the inward extent of a detent.

A plurality of detents 56 are formed on the base peripheral skirt 36 which extend inwardly toward the base side walls 30. Each base detent 56 is positioned to engage the inward protrusion of a lid detent 50 when the lid 42 is closed on the base 26. Hence, the closing of the lid 42 on the base drives the lid detents 50 outwardly to clear the base peripheral lip 34 and then inwardly into engagement with the base detents 56. When this engagement between the lid detents 50 and the base detents 56 takes place, the lid 42 is secured to the base 26 in a closed configuration. In addition, however, when the lid 42 is closed on the base 26, the card 22 is clasped between the base peripheral lip 34 and the top wall 48 of the lid, and is no longer engaged between the lid detents 50 and the lid top wall. Thus in the closed configuration the card 22 is securely supported around its entire perimeter and is thereby maintained in a flat orientation adjacent the lid top wall 48 for optimal display of any indicia 58 printed thereon.

A plurality of mating base and lid detents are provided on the container, and may be provided on a particular side of the container as two or more spaced detents, as shown in FIG. 3 on the sides of the container, or may be a single uninterrupted structure, as shown along the front of the container. As described in more detail below, the use of multiple detents along the sides facilitates obtaining a partially closed condition of the container in which only one set of detents on opposed sides are engaged.

The base detents 56 receive the lid detents 50 in a snap fit, and each base detent 56 has a lower segment 60 which extends upwardly from the base flange 38, and an upper segment 62 which extends upwardly and outwardly from the lower segment 60 to rejoin the base skirt 36 immediately below the base peripheral lip 34. The base detents 56, in addition to serving as portions of the container closure, also assist in restricting the too close nesting of adjacent containers 24 in a stack. By serving as denesting lugs the detents 56 facilitate the automatic loading and unloading of the containers 24.

The flange 38 on the base 26 and the flange 44 on the lid 42, are preferably provided with ribbed grip tabs 66, 68 which project outwardly from the flange and which are offset sidewardly from one another as shown in FIG. 1. To open the container assembly 20, a user may grasp the base 26 with one hand, and the lid 42 with the other, and apply oppositely directed forces to the grip tabs 66, 68 to cause the lid detents 50 to separate from the base detents 56. It will be noted that when the lid detents 50 leave engagement with the base 26, the card 22 will no longer be supported on the peripheral lip 34, but will be re-engaged by the lid detents 50, thereby causing the card to be once again connected to the lid to stay with the lid as it is opened fully.

In addition, the rear lid detents 64 which are closest to the hinge 40, when closed on the rear base detents, will retain the lid 42 in a partially closed configuration on the base 26. This configuration can be advantageous when using automatic container filling machinery. The partial close feature permits the lid 42 to be closed in two operations: a first pivoting or plowing operation, in which the lid is pivoted from an orientation which is approximately in the same plane as the base to an orientation in which the rear base detents are engaged; and a second operation in which the lid is driven downwardly at the front of the container to engage the front detents and fully close the container.

Because the same detents which hold the card associated with the lid in the open configuration also serve to clasp the lid to the base in the closed configuration, the container assembly has minimal visually obtrusive structure which might impede the graphic impact of the card. The card may thus be nearly as large as the container itself, providing a particularly attractive and eye-catching assembly. Because the container assembly does not have hang tabs or other extraneous elements associated with retail display, it is well suited to use as a table top product—that is, one that although usable for retail display, is also acceptable to consumers for display within their homes.

It should be noted that although a continuous card positioned in the lid has been shown, the lid card may be cut away in sections to permit the contents of the box to be viewed through the card. Alternatively, the interior portions of the lid top wall could be cut away leaving only the card to close in the lid. In addition, cards may be placed in the base of the container to underlie the container contents.

The container may be provided with additional structure for stacking, for example protruding feet on the base bottom wall, and recessed dimples on the lid top wall, to allow multiple units to be placed one upon another.

It is understood that the invention is not limited to the particular construction and arrangement of parts herein illustrated and described, but embraces such modified forms thereof as come within the scope of the following claims.

I claim:

1. A container comprising:

a base having a bottom wall with side walls which extend upwardly and terminate at an outwardly extending peripheral lip, wherein a skirt extends downwardly from the peripheral lip and wherein a plurality of detents extend inwardly from the skirt toward the side walls;

a lid connected to the base by a hinge, the lid having a flat continuous top wall with downwardly extending side walls, wherein the lid is pivotable between an open position and a closed position in which the lid side walls surround and engage the base skirt;

portions of the lid side walls which extend inwardly toward the base skirt to define a plurality of detents which extend into and engage the base skirt detents to retain the lid in a closed configuration on the base; and a stiff card of about the dimensions of the lid top wall positioned adjacent and beneath the flat lid top wall within the lid side walls, the stiff card being supported on the lid detents when the lid is disengaged from the base, such that the detents retain the card on the lid, and wherein the card is clasped between the base peripheral lip and the lid top wall when the lid is closed upon the base.

2. The container of claim 1 wherein each lid detent extends inwardly from a lid side wall a first distance, and wherein the width of the card at any selected position parallel to the hinge is no greater than a second distance equal to the spacing between the lid side walls at said selected position, and no less than the second distance reduced by the first distance.

3. The container of claim 1 wherein each lid detent has an upper segment which extends downwardly and inwardly from a lid side wall, and a lower segment which extends downwardly and outwardly from the upper segment.

4. The container of claim 1 wherein the lid side walls include a rear side wall adjacent the hinge, a front side wall positioned opposite the rear side wall, and two transverse side walls which extend between the rear side wall and the front side wall, and wherein at least two lid detents are provided on each transverse side wall, the lid detents on each of the transverse side walls being spaced from one another such that the lid may be closed on the base such that only the rearwardmost detents engage to partially close the container.

5. The container of claim 1 wherein a base flange extends outwardly from the base skirt, and wherein a lid flange extends outwardly from the lid side walls, and wherein the hinge extends between the base flange and the lid flange, and wherein the lid flange overlies the base flange when the lid is closed on the base.

6. The container of claim 1 wherein a base flange extends outwardly from the base skirt, and wherein a lid flange extends outwardly from the lid side walls, and wherein a grip tab extends outwardly from the base flange, and a grip tab extends outwardly from the lid flange, and wherein the lid grip tab is spaced from the base grip tab to provide spaced opposed surfaces to assist in the separation of the lid from the base.

7. A graphic card and container assembly comprising:

a base having a bottom wall with side walls which extend upwardly and terminate at an outwardly extending peripheral lip, wherein a skirt extends downwardly from the peripheral lip and wherein at least one detent extends inwardly from the skirt toward the side walls;

a lid associated with the base, the lid having a flat continous top wall with downwardly extending side walls, wherein the lid is pivotable between an open position and a closed position in which the lid side walls surround the base skirt;

portions of the lid side walls which extend inwardly toward the base skirt to define at least one detent which extends into and engages the base skirt detent to retain the lid in a closed configuration on the base; and a flat card positioned adjacent and beneath the lid top wall within the lid side walls, the flat card being supported on the at least one lid detent when the lid is disengaged from the base, such that the at least one detent retains the card on the lid, and wherein the card is clasped between the base peripheral lip and the lid top wall when the lid is closed upon the base.

8. The graphic card and container assembly of claim 7 wherein the at least one lid detent extends inwardly from a lid side wall a first distance, and wherein the width of the card at any selected position in a first direction is no greater than a second distance equal to the spacing between the lid side walls at said selected position, and no less than the second distance reduced by the first distance.

9. The graphic card and container assembly of claim 7 wherein the at least one lid detent has an upper segment which extends downwardly and inwardly from a lid side wall, and a lower segment which extends downwardly and outwardly from the upper segment.

10. The graphic card and container assembly of claim 7 wherein the lid side walls include a rear side wall adjacent the hinge, a front side wall positioned opposite the rear side wall, and two transverse side walls which extend between the rear side wall and the front side wall, and wherein at least two lid detents are provided on each transverse side wall, the lid detents on each of the transverse side walls being spaced from one another such that the lid may be closed on the base such that only the rearwardmost detents engage to partially close the container.

11. The graphic card and container assembly of claim 7 wherein a base flange extends outwardly from the base skirt, and wherein a lid flange extends outwardly from the lid side walls, and wherein the hinge extends between the base flange and the lid flange, and wherein the lid flange overlies the base flange when the lid is closed on the base.

12. The graphic card and container assembly of claim 7 wherein a base flange extends outwardly from the base skirt, and wherein a lid flange extends outwardly from the lid side walls, and wherein a grip tab extends outwardly from the base flange, and a grip tab extends outwardly from the lid flange, and wherein the lid grip tab is spaced from the base grip tab to provide spaced opposed surfaces to assist in the separation of the lid from the base.

* * * * *